US008164531B2

(12) United States Patent
Lier

(10) Patent No.: US 8,164,531 B2
(45) Date of Patent: Apr. 24, 2012

(54) ANTENNA ARRAY WITH METAMATERIAL LENS

(75) Inventor: Erik Lier, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 270 days.

(21) Appl. No.: 12/467,197

(22) Filed: May 15, 2009

(65) Prior Publication Data

US 2009/0289863 A1 Nov. 26, 2009

Related U.S. Application Data

(60) Provisional application No. 61/054,703, filed on May 20, 2008.

(51) Int. Cl.
*H01Q 19/06* (2006.01)

(52) U.S. Cl. ..... 343/753

(58) Field of Classification Search ..... 343/753, 343/754, 757, 911 R, 911 L, 762–763
See application file for complete search history.

(56) References Cited

U.S. PATENT DOCUMENTS 5,121,129 A * 6/1992 Lee et al. ..... 343/753
5,781,163 A * 7/1998 Ricardi et al. ..... 343/911 R
5,842,118 A * 11/1998 Wood, Jr. ..... 455/101
6,396,448 B1 * 5/2002 Zimmerman et al. ..... 343/753
6,590,544 B1 * 7/2003 Filipovic ..... 343/753
6,992,639 B1 1/2006 Lier
7,379,030 B1 5/2008 Lier
7,623,085 B1 11/2009 Lier
7,629,937 B2 12/2009 Lier et al.
2005/0225492 A1 10/2005 Metz
2007/0188385 A1 8/2007 Hyde et al.
2008/0048917 A1 2/2008 Achour et al.
2008/0165079 A1 7/2008 Smith et al.

OTHER PUBLICATIONS

Lier, "A Dielectric Hybrid Mode Antenna Feed: A Simple Alternative to the Corrugated Horn," IEEE Transactions on Antennas and Propagation, Jan. 1986, pp. 21-29, vol. AP-34, No. 1, IEEE.
Lier et al., "A New Class of Dielectric-Loaded Hybrid-Mode Horn Antennas With Selective Gain: Design and Analysis by Single Mode Model and Method of Moments," IEEE Transactions on Antennas and Propagation, Jan. 2005, pp. 125-138, vol. 53, No. 1, IEEE.
Lier et al., "Simple Hybrid Mode Horn Feed Loaded with a Dielectric Cone," Electronic Letters, 1985, pp. 563-561, No. 21.

* cited by examiner

*Primary Examiner* — Huedung Mancuso
(74) *Attorney, Agent, or Firm* — McDermott Will & Emery LLP

(57) ABSTRACT

An antenna array comprises two or more antenna elements. Each of the two or more antenna elements is configured to scan within a field of view. Each of the two or more antenna elements is further configured to transmit or receive a signal. The antenna array also comprises a metamaterial lens coupled to the two or more antenna elements. The metamaterial lens is configured to distribute the signal according to a sinc-like distribution over an aperture of the antenna array.

13 Claims, 8 Drawing Sheets

ANTENNA ARRAY WITH METAMATERIAL LENS

CROSS-REFERENCES TO RELATED APPLICATIONS

The present application claims the benefit of U.S. Provisional Patent Application Ser. No. 61/054,703, entitled "ZERO INDEX METAMATERIAL FOR GRATING-LOBE FREE LIMITED SCAN PHASED ARRAYS," filed on May 20, 2008, which is hereby incorporated by reference in its entirety for all purposes.

STATEMENT AS TO RIGHTS TO INVENTIONS MADE UNDER FEDERALLY SPONSORED RESEARCH OR DEVELOPMENT

Not Applicable.

FIELD

The present invention generally relates to antennas or materials and, in particular, relates to antenna arrays with metamaterial lenses.

BACKGROUND

Antennas exhibit a specific radiation pattern. The overall radiation pattern changes when several antenna elements are combined in an array. Side lobes are the lobes of the far field radiation pattern that are not the main beam. The number of side lobes increase with the number of elements. Most antennas generally have side lobes. For discrete aperture antennas, for example phased arrays, the aliasing effect causes some side lobes to become substantially larger in amplitude and approach the level of the main lobe with increasing scans. These side lobes are referred to as grating lobes, which are special cases of side lobes. These grating lobes follow the envelope element pattern when the antenna is scanned. Phased arrays may be restricted by grating lobes, which cause spatial interference and scan loss. In general, for antennas used as receivers, side lobes make the antenna more vulnerable to noise from nuisance signals coming far away from the transmit source. For transmit antennas communicating classified information, side lobes represent security vulnerability, as an unintended receiver may pick up the classified information or may simply cause interference in other receivers.

SUMMARY

In accordance with one aspect of the subject technology, an antenna array for minimizing grating lobes and scan loss is provided. According to one aspect of the subject technology, a metamaterial lens coupled to antenna elements of the antenna array provides an aperture distribution of signals such that grating lobes and scan loss are minimized. The metamaterial lens may comprise metamaterial having a relative dielectric constant of greater than zero and less than one.

According to one aspect of the subject technology, an antenna array comprises two or more antenna elements. Each of the two or more antenna elements is configured to scan within a field of view. Each of the two or more antenna elements is further configured to transmit or receive a signal. The antenna array also comprises a metamaterial lens coupled to the two or more antenna elements. The metamaterial lens is configured to distribute the signal according to a sinc-like distribution over an aperture of the antenna array.

According to another aspect of the subject technology, an antenna array comprises two or more antenna elements. Each of the two or more antenna elements is configured to scan within a field of view. Each of the two or more antenna elements is further configured to transmit or receive a signal. The antenna array also comprises a metamaterial lens coupled to the two or more antenna elements. The metamaterial lens comprises a first metamaterial having a first relative dielectric constant of greater than 0 and less than 1. The metamaterial lens also comprises a second metamaterial having a second relative dielectric constant of greater than 0 and less than 1. The first relative dielectric constant is different from the second relative dielectric constant.

According to yet another aspect of the subject technology, an antenna array comprises two or more antenna elements. Each of the two or more antenna elements is configured to scan within a field of view. Each of the two or more antenna elements is further configured to transmit or receive a signal. A spacing between each of the two or more antenna elements is greater than about two wavelengths. The antenna array also comprises a metamaterial lens coupled to the two or more antenna elements. The metamaterial lens is configured to distribute the signal according to a sinc-like distribution over an aperture of the antenna array. The metamaterial lens comprises a metamaterial having a relative dielectric constant of greater than 0.

Additional features and advantages of the invention will be set forth in the description below, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate aspects of the invention and together with the description serve to explain the principles of the invention.

DETAILED DESCRIPTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail so as not to obscure the present invention.

Figure 1:
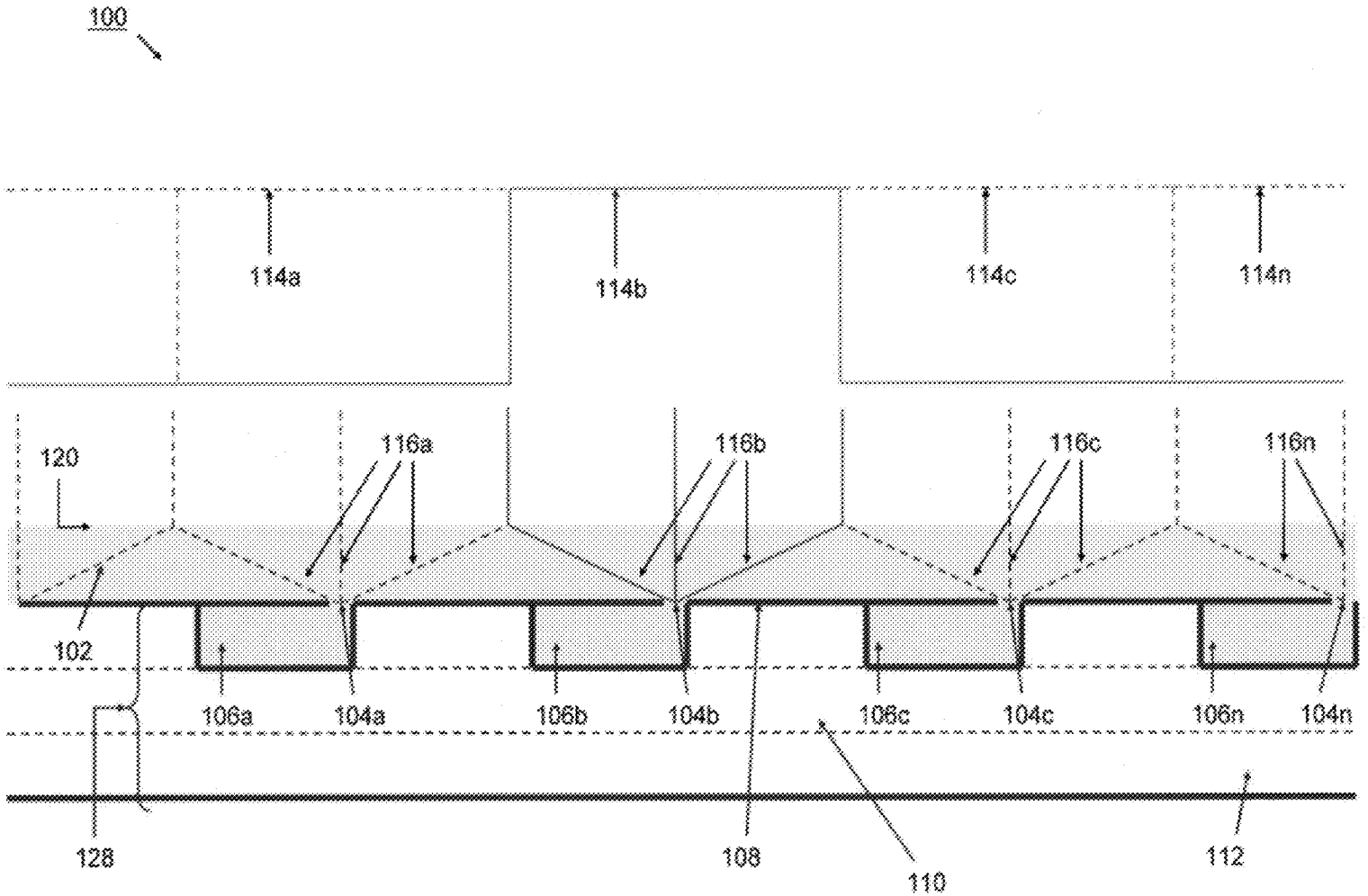
FIG. 1 illustrates an antenna array without an overlapped subarray, according to one approach.

FIG. 1 illustrates an antenna array 100 utilizing a uniform aperture distribution both for each array element and for the total array aperture distribution, according to one approach. Antenna array 100 comprises aperture 120, lens 102, feeding structure 128, any number of amplifiers 106 (as shown by amplifiers 106*a*, 106*b*, 106*c* and 106*n*), and any number of antenna elements 104 (as shown by antenna elements 104*a*, 104*b*, 104*c* and 104*n*). Feeding structure 128 comprises ground plane 108, radio frequency (RF) beamforming layer 110, and direct current (DC) and control layer 112. Aperture 120 is the physical flat area of antenna array 100, corresponding to the nominal interface between lens 102 and air. The electromagnetic radiation propagation of signals, for example, may occur at aperture 120. Lens 102 is coupled to the antenna elements 104. Each antenna element 104 may transmit or receive a complex RF signal, which comprises an amplitude and a phase. Lens 102 may distribute a power of the signal for each antenna element 104 according to an aperture distribution 114 (as shown by aperture distributions 114*a*, 114*b*, 114*c* and 114*n*). Aperture distribution 114 is a uniform aperture distribution corresponding to an amplitude and phase of the signal that is uniform over the physical area of each antenna element 104 and is zero outside of the physical area. For example, aperture distribution 114 may be a flat top function for each signal of the antenna elements 104. Such a distribution may occur with 100% aperture efficiency. The aperture distributions 114 of antenna array 100 may result in radiation patterns with significant side lobes, causing scan loss and grating lobes. According to one approach, antenna elements 104 are spaced half of a wavelength apart to avoid grating lobes for wide scanning arrays. Rays 116 (as shown by rays 116*a*, 116*b*, 116*c*, 116*n*) illustrate the propagation of individual rays of a respective signal for each antenna element 104.

Figure 2:
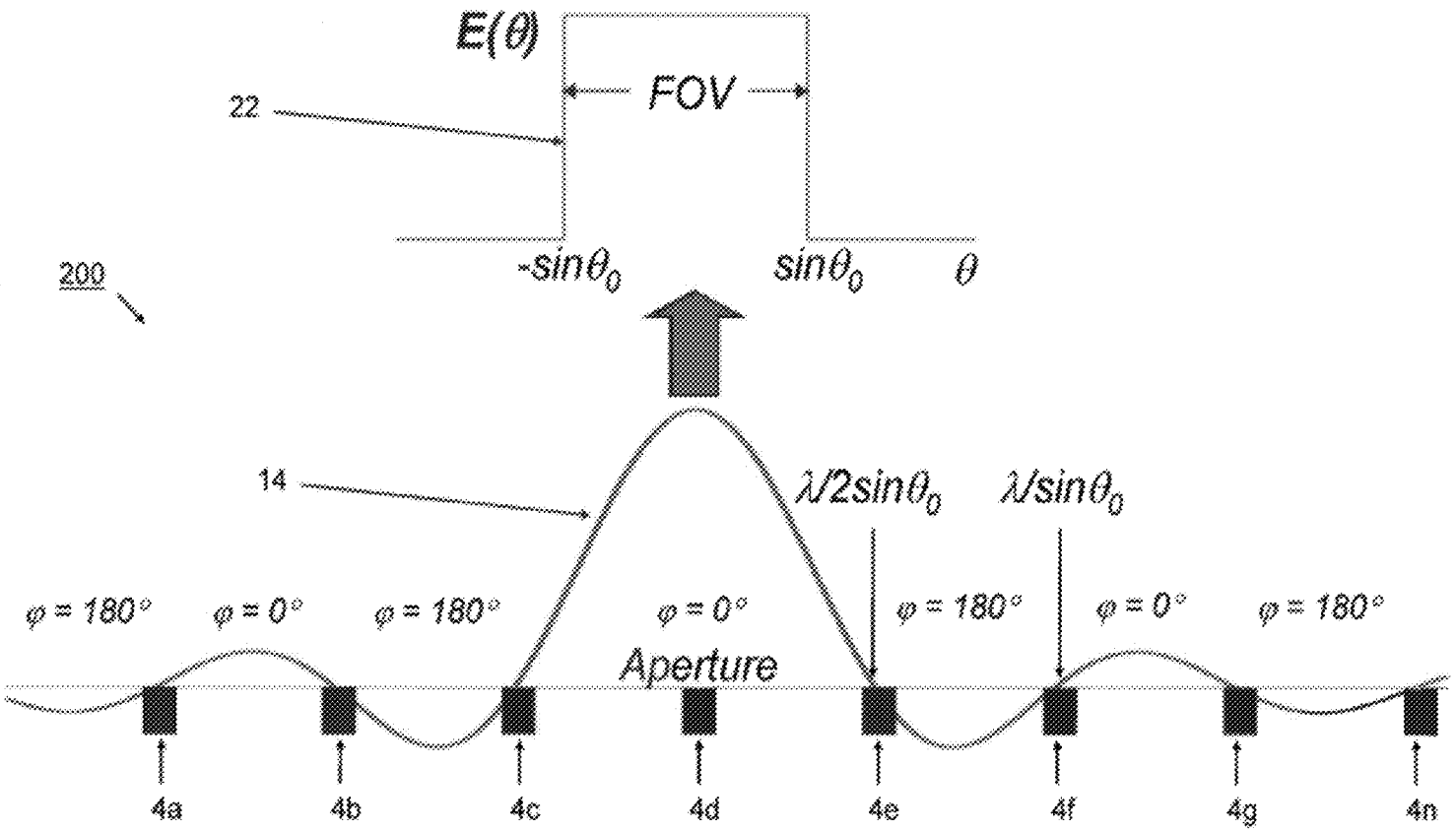
FIG. 2 illustrates an aperture distribution and a radiation pattern for an antenna element, in accordance with one aspect of the subject technology.

FIG. 2 illustrates an aperture distribution 14 and a flat top function radiation pattern 22 for an antenna element 4*d*, in accordance with one aspect of the subject technology. The total antenna radiation pattern of an antenna array 200 comprising a number of antenna elements 4 (as shown by antenna elements 4*a*, 4*b*, 4*c*, 4*d*, 4*e*, 4*f*, 4*g* and 4*n*) is given by: $P(\theta)=E(\theta)*AF(\theta)$, where $\theta$ is the scanning angle of the antenna array 200, $P(\theta)$ is the array antenna pattern, $E(\theta)$ is the radiation pattern for a given antenna element 4, and $AF(\theta)$ is the array factor which is a function of the element excitation (amplitude and phase) and element spacing. The phase excitation contained in $AF(\theta)$ defines the scanning angle $\theta$. In some aspects, the scanning angle $\theta$ is zero (boresight) corresponding to a uniform phase excitation over the antenna elements 4. In some aspects, the scanning angle $\theta$ may be different from zero, corresponding to a tapered (non-uniform) phase excitation over the antenna elements 4. Antenna array 200 may be a limited scan array, such as for geostationary earth orbit (GEO) or medium earth orbit (MEO) satellite antennas. For example, antenna array 200, or individual antenna elements 4 of antenna array 200, may scan within a field of view (FOV). In some aspects, the FOV corresponds to a maximum conical scanning angle of $\pm\theta_0$. For example, antenna array 200 may scan within a FOV corresponding to a maximum conical scanning angle of about ±9 degrees (e.g., a maximum scanning angle of 9 degrees in any direction). In one aspect, GEO satellite antennas may utilize an antenna array 200 with a maximum conical scanning angle of about ±9 degrees. In another example, antenna array 200 may scan within a FOV corresponding to a maximum conical scanning angle of about ±20-25 degrees (e.g., a maximum scanning angle of about 20-25 degrees in any direction). In one aspect, MEO satellite antennas may utilize an antenna array 200 with a maximum conical scanning angle of about ±20-25 degrees. In some aspects, limited scan arrays may be referred to as limited FOV arrays or grating lobe-free arrays.

According to one aspect of the subject technology, a limited scan array allows a larger spacing between antenna elements 4. In some aspects, the spacing between each of the antenna elements 4 is between about 2 and 5 wavelengths. For example, a GEO satellite antenna may utilize an antenna array 200 where the spacing between each antenna element 4 is between 2-3 wavelengths. In some aspects, the spacing between each of the antenna elements 4 is less than or equal to about 2 wavelengths. In some aspects, the spacing between each of the antenna elements 4 is greater than or about 5 wavelengths. According to one aspect of the subject technology, a larger spacing between antenna elements 4 is advantageous because of the reduced cost of having less antenna elements 4 in antenna array 200.

As shown in FIG. 2, a power of a signal transmitted or received by an antenna element 4 (such as antenna element 4*d*) is distributed according to aperture distribution 14, which may be a sinc-like distribution (e.g., a sin(x)/x linear distribution). In another aspect, aperture distribution 14 may be a J1(x)/x (2D) distribution. As shown in FIG. 2, aperture distribution 14 is a sinc-like distribution. In some aspects, if the phase $\phi$ of the signal is positive (e.g., about 180 degrees), the amplitude of the signal is negative. In some aspects, if the phase $\phi$ of the signal is about zero degrees, the amplitude of the signal is positive. In some aspects, the amplitude of the signal may be defined as always being positive so that the lowest amplitude of the signal may be zero or any other non-negative value. The sinc-like distribution may vary in one or two dimensions and produces (e.g., through a Fourier Transform) a flat top function radiation pattern 22 (amplitude pattern) for the antenna element 4. For example, the flat top function radiation pattern 22 is positive within the FOV (e.g., for a scanning angle within $\pm\theta_0$) and is substantially zero beyond the FOV (e.g., for a scanning angle beyond $\pm\theta_0$). Correspondingly, the flat top function radiation pattern 22 results in the minimization of grating lobes and scan loss within the FOV, in accordance with one aspect of the subject technology, since the scanning pattern including grating lobes is limited by the envelope of the element pattern, which in this case is a flat top function radiation pattern 22. Thus, in one aspect, a sinc-like distribution of the power of a signal minimizes grating lobes and scan loss by producing a flat top function radiation pattern 22.

In some aspects, for example in practical implementations, the sinc-like distribution may be truncated to overlap one or more adjacent antenna elements 4, which may make the flat top function radiation pattern 22 slightly different from a perfect flat area and different from zero outside of the central flat top area.

Figure 3:
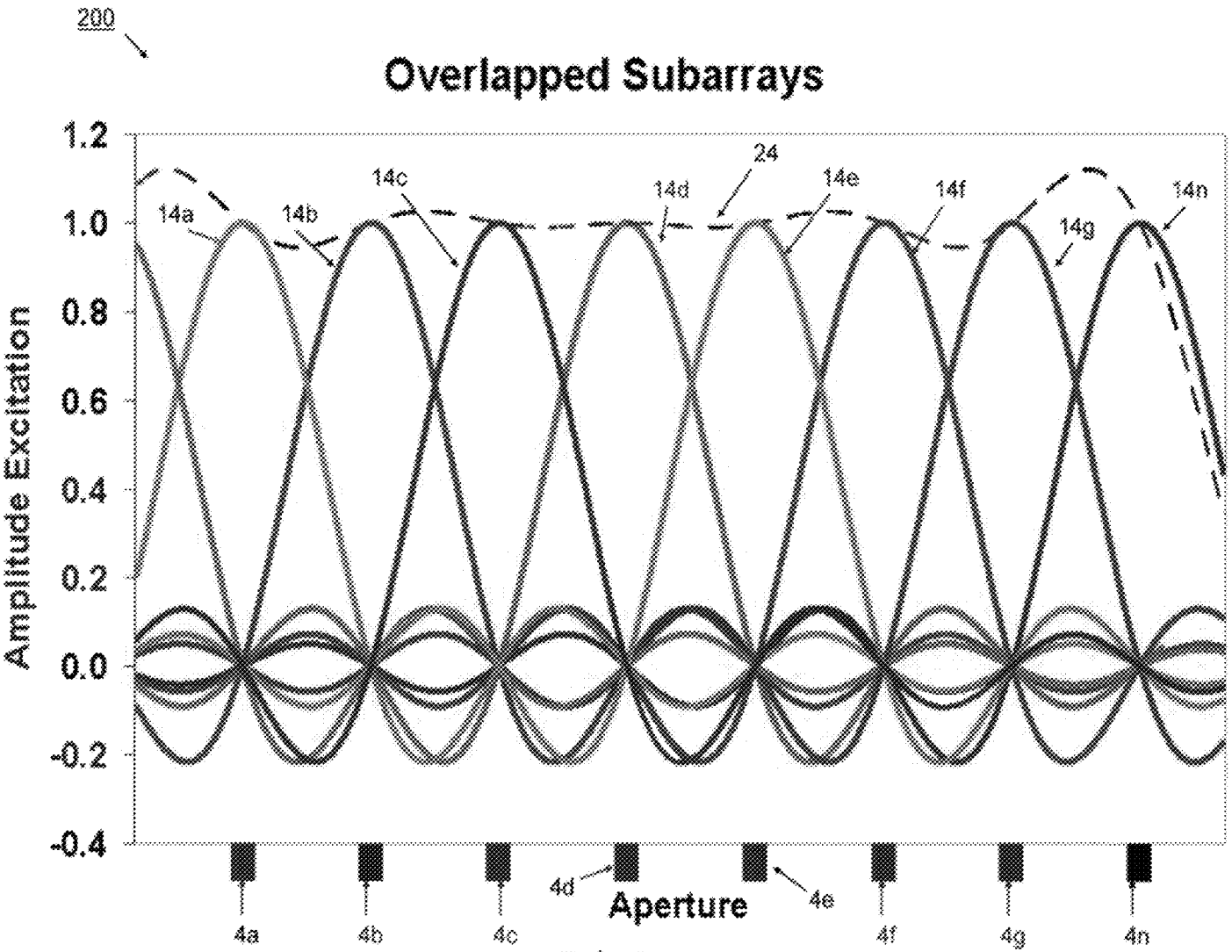
FIG. 3 illustrates an example of overlapped subarrays, in accordance with one aspect of the subject technology.

FIG. 3 illustrates an antenna array 200 with aperture distributions 14 (as shown by aperture distributions 14*a*, 14*b*, 14*c*, 14*d*, 14*e*, 14*f*, 14*g* and 14*n*) for respective antenna elements 4 (as shown by antenna elements 4*a*, 4*b*, 4*c*, 4*d*, 4*e*, 4*f*, 4*g* and 4*n*), in accordance with one aspect of the subject technology. In some aspects, each aperture distribution 14 may be referred to as a single subarray. Each of the aperture distributions 14 is a sinc-like distribution with portions that "overlap" with other aperture distributions 14 of the other antenna elements 4. The peak amplitude of the signal for each element 4 may occur at the null of adjacent elements 4. For example, amplitudes of the aperture distributions 14 (which may be sinc-like distributions) are substantially zero at adjacent antenna element locations. As a result, the sum 24 of the single subarrays produces a substantially uniform distribution, providing a high aperture efficiency. Referring to FIGS. 2 and 3, each aperture distribution 14 produces a flat top function radiation pattern 22. Thus, any side lobes that occur beyond the maximum conical scanning angle of $\pm\theta_0$ are substantially suppressed, in accordance with one aspect of the subject technology.

For a given aperture size, there may be a conflict between the number of array elements (or element spacing), and scan loss and grating lobes. Wide scanning arrays, for example radar antennas, may require approximately half a wavelength element spacing to avoid grating lobes while limited scanning arrays may allow two to three wavelength element spacing to keep grating lobes outside of the FOV (for example, satellite antennas). Overlapped subarrays may reduce grating lobes with scanning by creating a flat top element pattern via a sinc-like subbarray aperture distribution, in particular for limited scanning or limited FOV phased arrays.

In accordance with another aspect of the subject technology, for limited scan arrays, the use of overlapped subarrays may minimize the effect of grating lobes and scan loss, such as spatial interference. According to some approaches, overlapped subarrays may be based on aperiodic arrays, constrained networks, or cascaded or space-fed networks. However, these approaches may render the implementation of overlapped subarrays impractical to implement in the analog domain due to the large cost, volume and mass increase associated with such approaches. In another approach, grating lobe-free scanning may be achieved in the digital domain, but is also expensive to implement. Still, in other approaches, known implementations are bulky and not practical.

Figure 4:
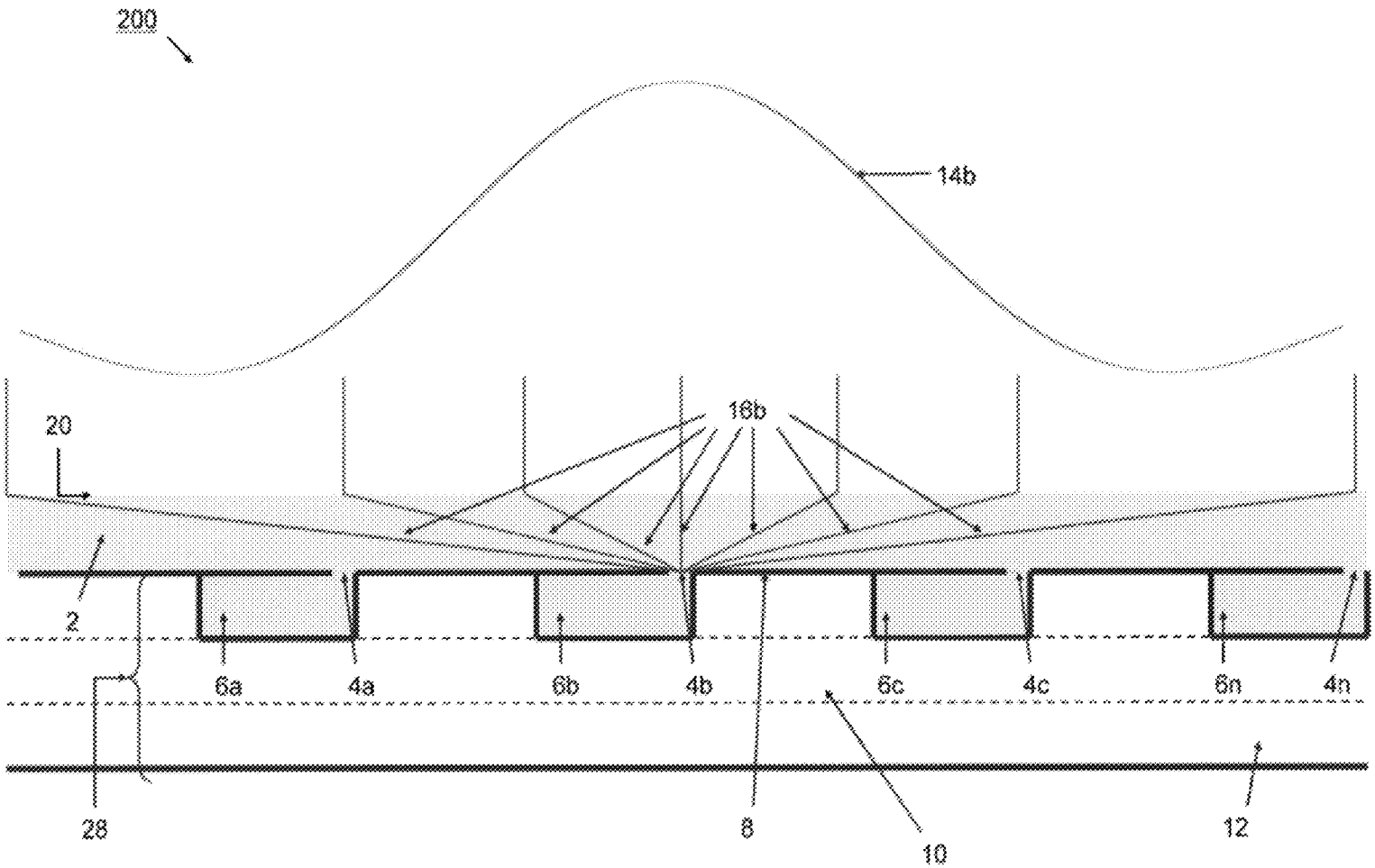
FIG. 4 illustrates an example of a configuration of an antenna array, in accordance with one aspect of the subject technology.

FIG. 4 illustrates a configuration of antenna array 200, in accordance with one aspect of the subject technology. Antenna array 200 comprises aperture 20, metamaterial lens 2, feeding structure 28, any number of amplifiers 6 (as shown by amplifiers 6*a*, 6*b*, 6*c* and 6*n*), and any number of antenna elements 4 (as shown by antenna elements 4*a*, 4*b*, 4*c*, and 4*n*). Feeding structure 28 comprises ground plane 8, beamforming multi-layer board 10 for radio frequencies (RF), and DC and control layer 12 for DC and control distribution. Aperture 20 is the physical flat area of antenna array 200, corresponding to the nominal interface between metamaterial lens 2 and air. The electromagnetic radiation propagation of signals, for example, may occur at aperture 20. In some embodiments, aperture 20 is the two dimensional plane on top of, over, or on the outer layer, of metamaterial lens 2. In some embodiments, aperture 20 is where the signal propagates from the metamaterial lens 2 to free space or vice versa.

Metamaterial lens 2 is coupled to the antenna elements 4. For example, metamaterial lens 2 may be placed over, placed in front of, or encapsulate antenna elements 4. Metamaterial lens 2 may comprise a zero or low index metamaterial. In some aspects, the metamaterial may have a low refractive index, i.e., between zero and one. In some aspects, the metamaterial may have a refractive index above one. In some aspects, the metamaterial may have a refractive index above zero. Refractive index is usually given by $n=\sqrt{(\epsilon_r\mu_r)}$, where $\epsilon_r$ is the material's relative permittivity (or relative dielectric constant) and $\mu_r$ is its relative permeability. In one aspect of the disclosure, $\mu_r$ is very close to one, therefore n is approximately $\sqrt{\epsilon_r}$.

By definition, a vacuum has a relative dielectric constant of one and most materials have a relative dielectric constant of greater than one. Some metamaterials have a negative refractive index, e.g., have a negative relative permittivity or a negative relative permeability and are referred to as single-negative (SNG) media. Additionally, some metamaterials have a positive refractive index but have a negative relative permittivity and a negative relative permeability; these metamaterials are referred to as double-negative (DNG) media. It may be generally understood that metamaterials possess artificial properties, e.g., not occurring in nature, such as negative refraction index.

According to one aspect of the subject technology, metamaterial lens 2 comprises a metamaterial having a relative dielectric constant of greater than zero and less than one. The relative dielectric constant of metamaterial lens 2 may vary in all directions. In some aspects, metamaterial lens 2 comprises a metamaterial having a permeability of approximately one. In these aspects, metamaterial lens 2 has a positive refractive index greater than zero and less than one.

Each antenna element 4 may transmit or receive a signal, which comprises an amplitude and a phase. Amplifiers 6, coupled to a respective antenna element 4, may amplify the signals transmitted or received by the antenna elements 4. For example, amplifiers 6 may be solid state power amplifiers for transmitting or low noise amplifiers for receiving. According to one aspect of the subject technology, overlapped subarrays can be implemented based on the use of metamaterial lens 2, which may spread out the energy away from antenna elements 4 (with a reciprocal effect for receiving antenna elements 4). For example, metamaterial lens 2 may distribute a power of the signal for each antenna element 4 according to aperture distribution 14 (as shown by aperture distributions 14*a*, 14*b*, 14*c*, 14*d*, 14*e*, 14*f* and 14*n* in FIGS. 2-4) over aperture 20. Aperture distribution 14 may be a sinc-like distribution of the amplitude of the signal. In another aspect, aperture distribution 14 may be a J1(x)/x (2D) distribution. In one aspect, aperture distribution 14 can dramatically improve the performance of a limited scan array with antenna element 4 spacing in the order of 2 to 5 wavelengths or more, depending on the scan requirement (e.g., typically 2.5-3.0 wavelengths for GEO antennas).

By way of example, a Supertile phased array could be equipped with such metamaterial lens 2, replacing the 4-way waveguide divider and 4 helix elements with a simple dipole or slot radiator. Metamaterial lens 2 may considerably reduce the mass and cost of the array.

Rays 16 (as shown by rays 16*b* for respective antenna element 4*b*) illustrate the propagation of individual rays 16 of a respective signal for each antenna element 4. The amplitude and phase of each signal passed through the metamaterial lens 2 may be controlled to achieve the aperture distribution 14, such as the sinc-like distribution. For example, ray tracing, finite elements, finite difference, methods of moments, transformation optics, or other suitable techniques may be performed to determine the amplitude and phase needed for each ray 16 of the signal to achieve the aperture distribution 14. According to one aspect of the subject technology, once the amplitude and phase has been determined, the metamaterial lens 2 may be adapted with suitable varying relative dielectric constants to distribute the signal according to the aperture distributions 14. For example, various relative dielectric constants may be synthesized or optimized throughout the metamaterial lens 2 to achieve the sinc-like distributions for each antenna element 4. In some aspects, the optimization may be performed over a portion of a frequency band or the whole frequency band. In some aspects, the optimization is performed over a narrow frequency band, such as between about 1-5% of the frequency band. In some aspects, the optimization is performed over a larger frequency band, such as between about 5-15% of the frequency band. In some aspects, the optimization may be performed over a wide frequency band, such as greater than 15% of the frequency band.

Figure 5:
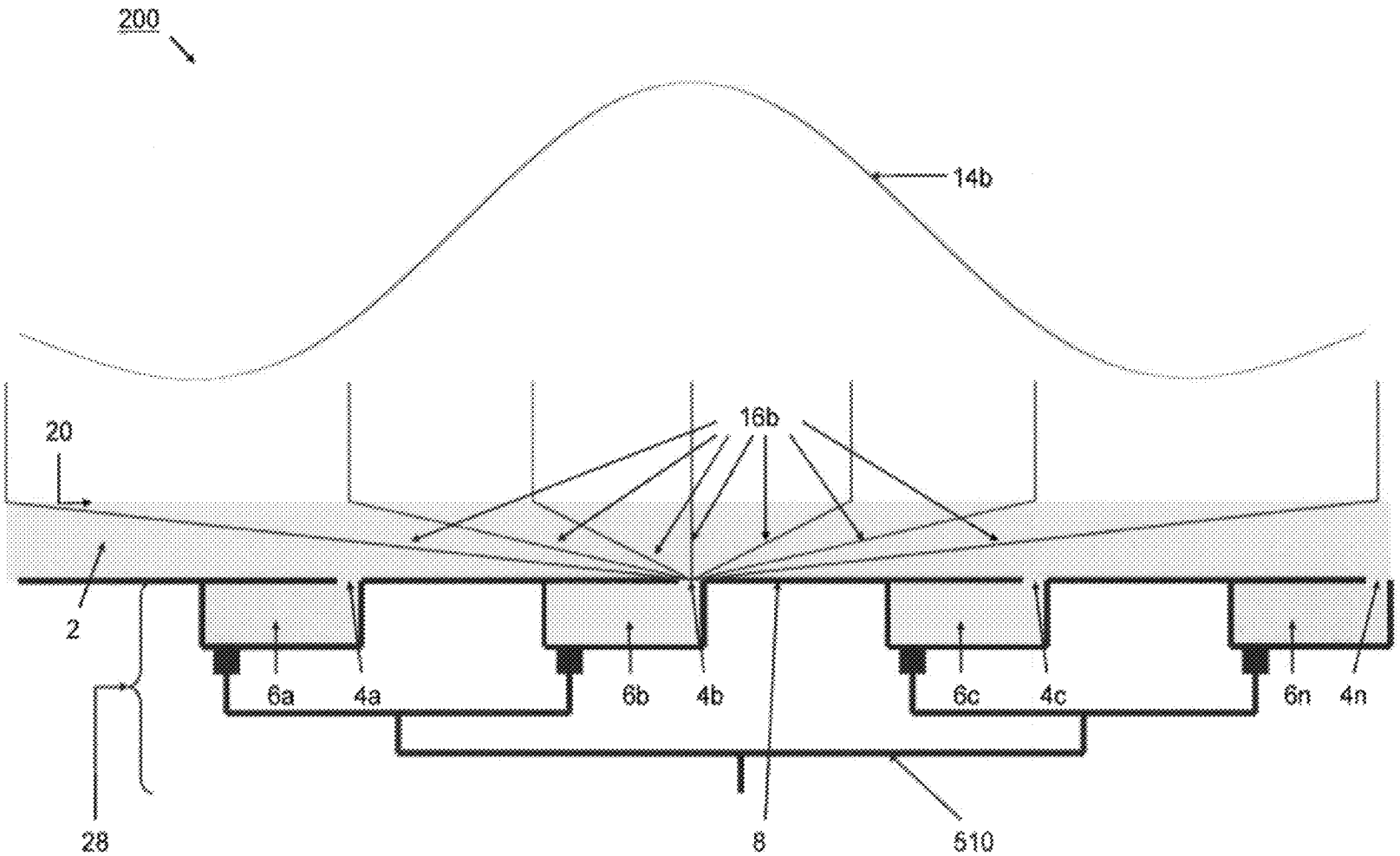
FIG. 5 illustrates an example of a configuration of an antenna array, in accordance with one aspect of the subject technology.

In some aspects, feeding structure 28 inputs or outputs the signal for each antenna element 4. Feeding structure 28 may be a microstrip or stripline circuit, stripline multilayer board, coaxial network, waveguide network, or other suitable feeding structures for antenna array 200. FIG. 5 illustrates another configuration of antenna array 200, in accordance with one aspect of the subject technology. As shown in FIG. 5, antenna array 200 comprises a different feeding structure 28. In this example, feeding structure 28 comprises amplifiers 6, ground plane 8, and a corporate beamforming network 510 implemented with coaxial cables.

Figure 6:
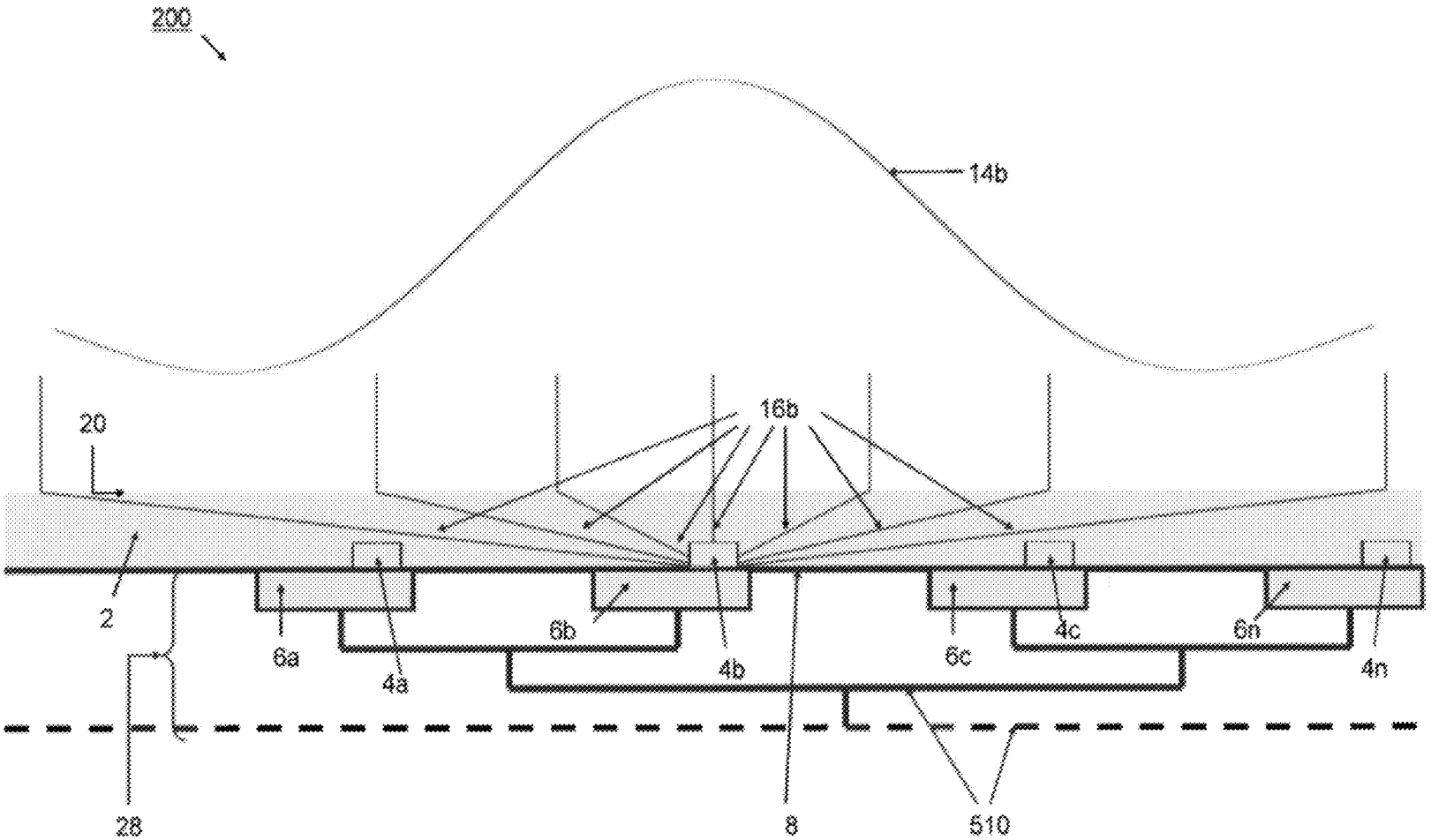
FIG. 6 illustrates an example of a configuration of an antenna array, in accordance with one aspect of the subject technology.

FIG. 6 illustrates another configuration of antenna array 200, in accordance with one aspect of the subject technology. Antenna elements 4 may be any generic antenna element. For example, antenna elements 4 may comprise microstrip patch antenna elements, dielectric resonator antenna elements, dipole antenna elements, slot antenna elements, or other suitable generic antenna elements. Also shown in FIG. 6, antenna elements 4 may be encapsulated or covered by metamaterial lens 2.

Figure 7:
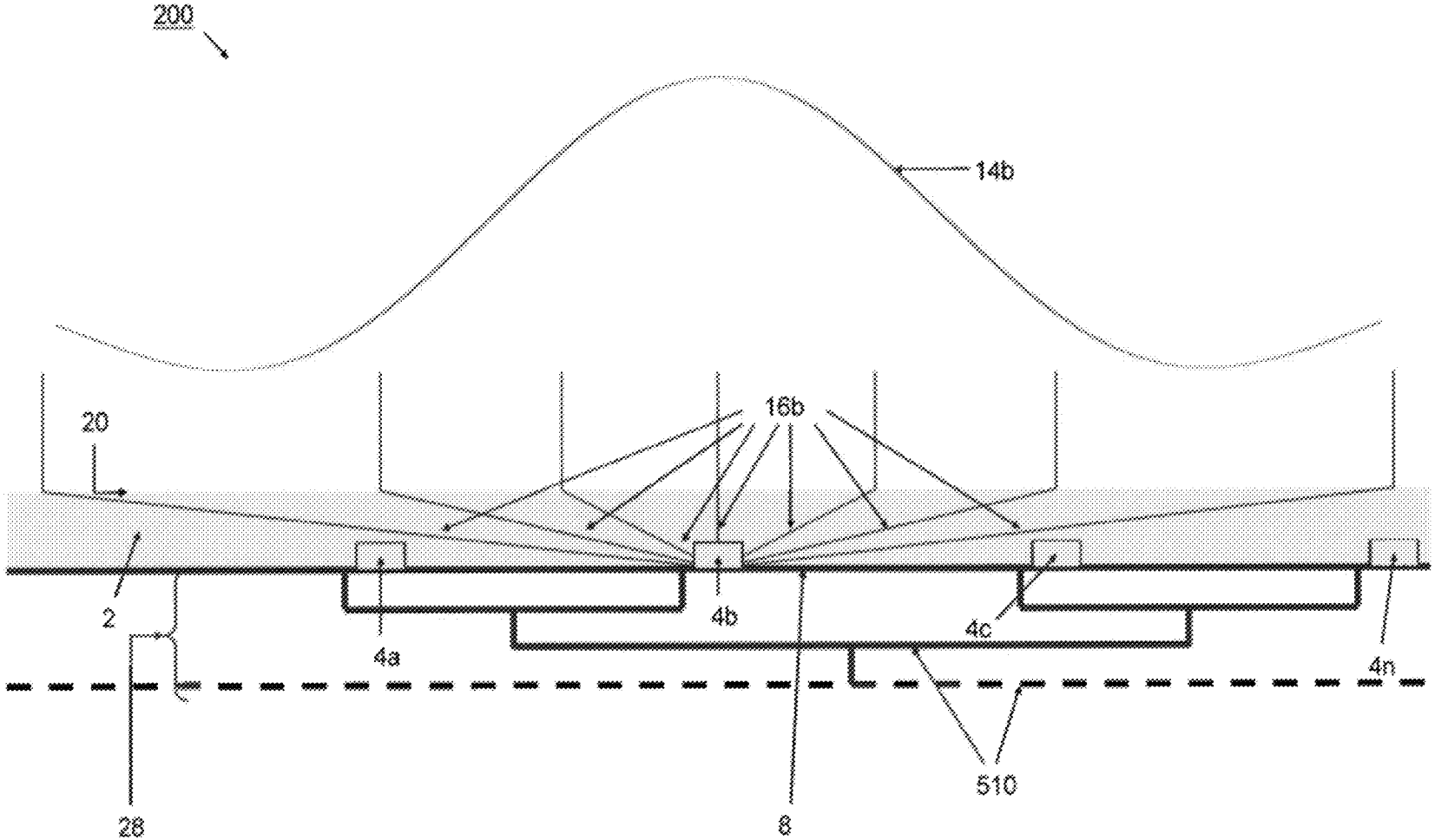
FIG. 7 illustrates an example of a configuration of an antenna array, in accordance with one aspect of the subject technology.

FIG. 7 illustrates another configuration of antenna array 200, in accordance with one aspect of the subject technology. Antenna array 200 may be a limited scanning array, phased array, active array, passive array, any suitable combination of the foregoing arrays, or other suitable antenna arrays. In some aspects, an antenna array does not require antenna elements 4 to be lined in certain configurations. As shown in FIG. 7, antenna array 200 is a passive antenna array, where a corresponding amplifier 6 is not directly coupled to each antenna element 4, as was shown in the previous configurations (antenna array 200 of FIGS. 4-6). In another aspect of the subject technology, antenna array 200 comprises linear as well as two dimensional (e.g., flat) and three dimensional (e.g., curved) arrays, with single or dual polarizations.

FIGS. 8A, 8B, 8C and 8D illustrate various configurations of metamaterial lens 2, in accordance with various aspects of the subject technology. Metamaterial lens 2 may comprise various portions 26 (as shown by portions 26*a*, 26*b*, 26*c*, 26d, 26e and 26*n*) of metamaterial. In some aspects, portions 26 may be layers, volumes, spheres, or other suitable portions 26 of metamaterial. In some aspects, the relative dielectric constant of portions 26 is constant within metamaterial lens 2, the thickness of the portions 26 is constant within metamaterial lens 2, and the relative permittivity of the portions 26 is constant within metamaterial lens 2. In some aspects, the relative dielectric constant of one, several or all of the portions 26 may vary with distance (e.g., continuously, linearly or in some other manner) in one, some or all directions. In some aspects, the thickness of one, several or all of the portions 26 may vary (e.g., continuously, linearly or in some other manner) in one, some or all directions. In some aspects, the relative permittivity of one, several or all of the portions 26 may vary (e.g., continuously, linearly or in some other manner) in one, some or all directions. In some aspects, the thickness of metamaterial lens 2 may vary.

In some aspects, portions 26 comprises dielectric material and metal material. In some aspects, metal material may include any low loss metals. For example, metal material may include copper, silver, any combination of copper and silver, or any other suitable metals. In some aspects, portions 26 comprise only dielectric material and does not comprise metal material.

Figures 8A, 8B, 8C, 8D:
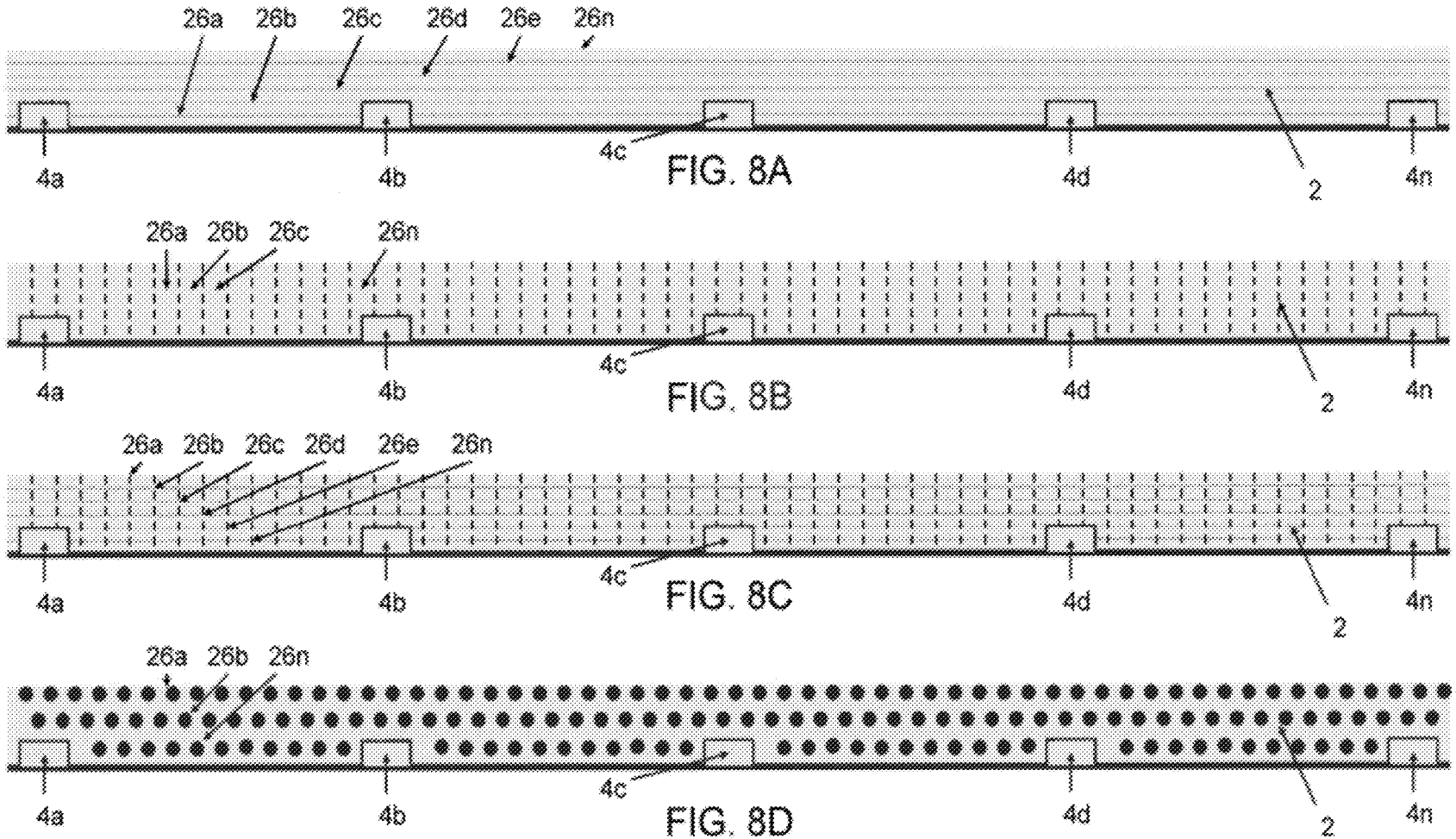
FIGS. 8A, 8B, 8C and 8D illustrate examples of various configurations of a metamaterial lens, in accordance with various aspects of the subject technology.

FIG. 8A illustrates metamaterial lens 2 with portions 26 of metamaterial. In this example, the portions 26 are layers of metamaterial, which may have different effective relative dielectric constants. For example, the relative dielectric constant of portion 26*a* may be lower than the relative dielectric constant of portion 26*b*. The relative dielectric constant of portions 26 may become increasingly lower towards the outermost portion 26*n*. In another example, the relative dielectric constant of portion 26*a* may be greater than the relative dielectric constant of portion 26*b*. The relative dielectric constant of portions 26 may become increasingly larger towards the outermost portion 26*n*. The relative dielectric constants of portions 26 may vary in any manner and in any direction. For example, FIG. 8B illustrates the relative dielectric constant of portions 26 varying along the metamaterial lens 2 direction. In another example, FIG. 8C illustrates the relative dielectric constants of portions 26 varying in different volumes in all directions throughout metamaterial lens 2. In another example, FIG. 8D illustrates portions 26 as comprising only dielectric material and formed as spheres with different relative dielectric constants, which may vary in any manner and in any direction. In another example, metamaterial lens 2 may include one or more dielectric materials and one or more other types of materials (e.g., one or more metals), and these may be distributed in various ways (in a uniform or non-uniform fashion). In some aspects, one or more metals may be represented by the dashed lines shown in FIGS. 8A, 8B and 8C. These are merely examples, and the subject technology is not limited to these examples.

In accordance with one aspect of the disclosure, the subject technology may be used in various markets, including markets related to radar and active phased arrays.

The foregoing description is provided to enable a person skilled in the art to practice the various configurations described herein. While the present invention has been particularly described with reference to the various figures and configurations, it should be understood that these are for illustration purposes only and should not be taken as limiting the scope of the invention.

There may be many other ways to implement the invention. Various functions and elements described herein may be partitioned differently from those shown without departing from the sprit and scope of the invention. Various modifications to these configurations will be readily apparent to those skilled in the art, and generic principles defined herein may be applied to other configurations. Thus, many changes and modifications may be made to the invention, by one having ordinary skill in the art, without departing from the spirit and scope of the invention.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. An antenna array comprising:

two or more antenna elements, each of the two or more antenna elements configured to scan within a field of view, each of the two or more antenna elements further configured to transmit or receive a signal; and a metamaterial lens coupled to the two or more antenna elements, the metamaterial lens configured to distribute the signal according to a sinc-like distribution over an aperture of the antenna array, wherein the sinc-like distribution comprises a sin(x)/x linear distribution.

2. The antenna array of claim 1, further comprising two or more amplifiers, each of the two or more amplifiers coupled to a corresponding antenna element of the two or more antenna elements, each of the two or more amplifiers configured to amplify the signal.

3. The antenna array of claim 1, further comprising a feeding structure configured to output the signal, the feeding structure comprising a microstrip circuit, stripline circuit, a coaxial network, or a waveguide network.

4. The antenna array of claim 1, wherein amplitudes of the sinc-like distribution are substantially zero at adjacent antenna element locations.

5. The antenna array of claim 1, wherein the field of view corresponds to a maximum scanning angle of about 25 degrees in any direction for each of the two or more antenna elements.

6. The antenna array of claim 1, wherein a spacing between each of the two or more antenna elements is greater than about two wavelengths.

7. The antenna array of claim 1, wherein the sine-like distribution produces a flat top function radiation pattern, wherein the flat top function radiation pattern is positive within the field of view and substantially zero beyond the field of view.

8. The antenna array of claim 1, wherein the metamaterial lens comprises a metamaterial having a relative dielectric constant of greater than 0.

9. The antenna array of claim 8, wherein the metamaterial comprises dielectric material.

10. The antenna array of claim 9, wherein the metamaterial further comprises metal.

11. The antenna array of claim 1, wherein the metamaterial lens comprises a first metamaterial layer and a second metamaterial layer, wherein the first metamaterial layer comprises a first relative dielectric constant, wherein the second metamaterial layer comprises a second relative dielectric constant, and wherein the first relative dielectric constant is greater than the second relative dielectric constant.

12. The antenna array of claim 1, wherein the two or more antenna elements comprise microstrip patch antenna elements, dielectric resonator antenna elements, dipole antenna elements, or slot antenna elements.

13. An antenna array comprising:

two or more antenna elements, each of the two or more antenna elements configured to scan within a field of view, each of the two or more antenna elements further configured to transmit or receive a signal, wherein a spacing between each of the two or more antenna elements is greater than about two wavelengths; and a metamaterial lens coupled to the two or more antenna elements, the metamaterial lens configured to distribute the signal according to a sinc-like distribution over an aperture of the antenna array, the metamaterial lens comprising a metamaterial having a relative dielectric constant of greater than 0, wherein the sinc-like distribution comprises a sin(x)/x linear distribution.

* * * * *